US006547525B2

(12) United States Patent
Haehnle et al.

(10) Patent No.: US 6,547,525 B2
(45) Date of Patent: Apr. 15, 2003

(54) COOLED COMPONENT, CASTING CORE FOR MANUFACTURING SUCH A COMPONENT, AS WELL AS METHOD FOR MANUFACTURING SUCH A COMPONENT

(75) Inventors: Hartmut Haehnle, Kuessaberg (DE); Ibrahim El-Nashar, Kloten (CH); Rudolf Kellerer, Waldshut (DE); Beat Von Arx, Trimbach (CH)

(73) Assignee: Alstom (Switzerland) Ltd, Baden (CH)

( * ) Notice: Subject to any disclaimer, the term of this patent is extended or adjusted under 35 U.S.C. 154(b) by 0 days.

(21) Appl. No.: 09/984,204

(22) Filed: Oct. 29, 2001

(65) Prior Publication Data

US 2002/0051706 A1 May 2, 2002

(30) Foreign Application Priority Data

Oct. 27, 2000 (DE) ..... 100 53 356

(51) Int. Cl.[7] ..... F01D 5/08
(52) U.S. Cl. ..... 416/97 R; 416/96 R; 415/115
(58) Field of Search ..... 416/97 R, 213 R, 416/229 A, 233, 95, 96 R; 415/115

(56) References Cited

U.S. PATENT DOCUMENTS 3,111,302 A * 11/1963 Bowmer
3,542,486 A * 11/1970 Kercher et al. ..... 416/90
4,293,275 A 10/1981 Kobayashi et al.
4,507,051 A * 3/1985 Lesgourgues et al. .... 419/97 R
5,002,460 A 3/1991 Lee et al.
5,498,133 A * 3/1996 Lee ..... 416/97 R

FOREIGN PATENT DOCUMENTS

GB 2 202 907 A 10/1988

* cited by examiner

*Primary Examiner*—Edward K. Look
*Assistant Examiner*—J M McAleenan
(74) *Attorney, Agent, or Firm*—Burns, Doane, Swecker & Mathis, L.L.P.

(57) ABSTRACT

A cooled component, such as a turbine blade for gas turbines is provided, having efficient internal cooling, with an interior cooling passageway having a round cross-section. A row of feeding holes for the coolant are arranged spaced from each other in the direction of the longitudinal axis of the cooling passageway and originating from a common coolant channel. Each of the feeding holes intersects the cooling passageway tangentially. The ease of manufacturing the cooling component is improved in that the majority of the feeding holes have a hole diameter that is smaller than half of the hydraulic diameter of the cooling passageway, and selected feeding holes have a hole diameter that is greater than half of the hydraulic diameter of the cooling channel.

9 Claims, 3 Drawing Sheets

COOLED COMPONENT, CASTING CORE FOR MANUFACTURING SUCH A COMPONENT, AS WELL AS METHOD FOR MANUFACTURING SUCH A COMPONENT

FIELD OF THE INVENTION

The present invention relates to the field of technology of gas turbines. More particularly, the invention is directed to a cooled component for gas turbines and a casting core and method for manufacturing the cooled component, which can be in the form of a turbine blade.

BACKGROUND OF THE INVENTION

The efficiency of gas turbines is related very closely to the inlet temperature for the hot combustion gases, and preferably is kept as high as possible for efficient fuel consumption and economy. The efficiency depends on an efficient use of the cooling air that generally serves as a coolant from the compressor stage, for reasons related to material technology. Operational safety and life span of the gas turbine require sufficient cooling of the thermally highly loaded turbine components or elements that include, especially on the inlet side, guide blades and rotating blades of the first turbine stages. The cooling can be performed in different ways, that include as examples, internal cooling by circulating cooling air in the interior of the component, and film cooling by generating a cooling air film using suitably arranged outlet openings on the exterior of the component exposed to the thermal loads.

A known method for the efficient interior cooling of a turbine component is disclosed as a "cyclone" or "vortex chamber" in GB-A-2 202 907. With such a "cyclone", a longitudinal cooling channel that in most cases has a circular or elliptical cross-section is fed with cooling air from a row of feeding holes that enter the longitudinal cooling channel tangentially. The inflowing cooling air forms a whirl in the cooling channel, which rotates around the longitudinal axis of the channel and which, because of the high speed and turbulence in the marginal area, brings about a particularly effective cooling of the channel wall and therefore of the cooled component.

FIG. 1 shows a simplified, perspective drawing of a turbine blade 10 with cyclone cooling. The turbine blade 10 is shown "transparently" so that the interior cavities and channels can be seen in the form of solid lines. The turbine blade 10 has a leading edge 13 and a trailing edge 14 that each extend in the longitudinal direction of the blade between the blade base 11 and blade tip 12. In order to simplify the drawing, the special design of the blade base 11 for attaching the blade to the rotor and supplying the blade with cooling air, as disclosed, for example, in U.S. Pat. Nos. 4,293,275 and 5,002,460, which are incorporated herein in their entireties by reference, is not shown in FIG. 1.

For the internal cooling of the turbine blade 10, cooling air is fed from the blade base 11 through a connecting channel (not shown) into a coolant channel 15 extending in the longitudinal direction of the blade (as represented by vertical arrows in FIG. 1). Parallel to the coolant channel 15 and parallel to the highly thermally loaded leading edge 13 of the turbine blade 10 that is to be cooled, extends a cylindrical cooling passageway 16 that forms the cyclone. A row of spaced feeding holes 17 extend toward the cooling passageway 16 from the coolant channel 15, and intersect the cooling passageway approximately tangentially. The cooling air (as represented by horizontal arrows in FIG. 1) flows through the feeding holes 17 into the cooling passageway 16 approximately at a tangent to an outer perimeter of the cooling passageway 16, and forms a whirl or cyclone that extends across the cooling passageway 16. The whirl of cooling air in the cooling passageway 16 absorbs heat from the surrounding channel wall. The heated cooling air either leaves the cooling passageway 16 at the end face or—as shown in GB-A-2 202 907-through tangential outlets in the form of holes or slits. Other devices for internal cooling can be used simultaneously for film cooling and/or are connected with the trailing edge 14, but are not shown in FIG. 1 for simplicity.

The effect of the cyclone cooling depends to a great degree on the supply of coolant, which can be affected by factors that include marginal conditions, location and cross-sections of the feeding holes, etc. As a result of some of these factors, feeding holes 17 are preferably provided with a diameter that is smaller than half of the hydraulic diameter of the cooling passageway 16. Since a turbine blade 10 of the type shown in FIG. 1 is usually produced using a metal casting process, a corresponding casting core with several interconnections must be used for constructing the coolant channel 15, cooling passageway 16, and the drilled supply bores 17 connecting these two. The weak points of such a casting core are the connecting members, which are relatively thin because of the above-mentioned requirement with respect to diameter, and which form the feeding holes during the casting. The core therefore could easily break at this point, which would jeopardize the casting success.

SUMMARY OF THE INVENTION

In view of the above problems with conventional cooled components and methods of manufacturing the components, the invention is directed to a gas turbine component that can be produced by a casting process in such a way that the occurrence of core breaks during the casting is effectively restricted, and the production rate achieved during casting is clearly improved.

According to aspects of an embodiment of the invention, the feeding holes are produced in such a way that the rigidity of the associated casting core is improved while still fulfilling the specified diameter requirements for the feeding holes. In a preferred embodiment of the invention, the majority of the feeding holes have a diameter that is smaller than half of the hydraulic diameter of the cooling channel. In order to improve the production rate during the casting of the cooled component, selected feeding holes are provided with a hole diameter that is greater than half of the hydraulic diameter of the cooling passageway.

According to an embodiment of the invention, the selected feeding holes having diameters that are greater than half of the hydraulic diameter of the cooling passageway each are provided at or near the ends of the cooling passageway. In a preferred embodiment of the invention the feeding holes at the very ends of the cooling passageway are used as the selected feeding holes. With this preferred embodiment, the desired cooling air whirl or cyclone within the cooling passageway is able to form almost without restriction across the entire interior of the cooling passageway, thereby maximizing the cooling effect.

With a cooled component, such as a turbine blade, where the length of the component may have an effect on the stability of the core, selected feeding holes may be provided additionally in the middle part of the cooling passageway.

According to aspects of an embodiment of the invention, a casting core for manufacturing a cooled component as described above comprises a first channel portion for forming the coolant channel and a second channel portion for forming the cooling passageway, as well as a plurality of connecting members that extend transversely between the two channel portions and function to form the feeding holes. The majority of the connecting members have an outer diameter that is smaller than half of the hydraulic diameter of the cooling passageway, and selected connecting members can be provided with an outer diameter that is greater than half of the hydraulic diameter of the cooling passageway.

The selected connecting members, each having an outer diameter that is greater than half of the hydraulic diameter of the cooling passageway, are provided at the ends of the second channel part. In an embodiment of the invention, the last connecting member at each end of the cooling passageway are used as the selected connecting members.

The method according to the invention for manufacturing the cooling component according to the invention includes a metal casting process that uses a casting core according to the invention.

BRIEF DESCRIPTION OF THE DRAWINGS

The invention is explained below with reference to the embodiments shown in the drawings, wherein.

DETAILED DESCRIPTION OF THE INVENTION

Figure 1:
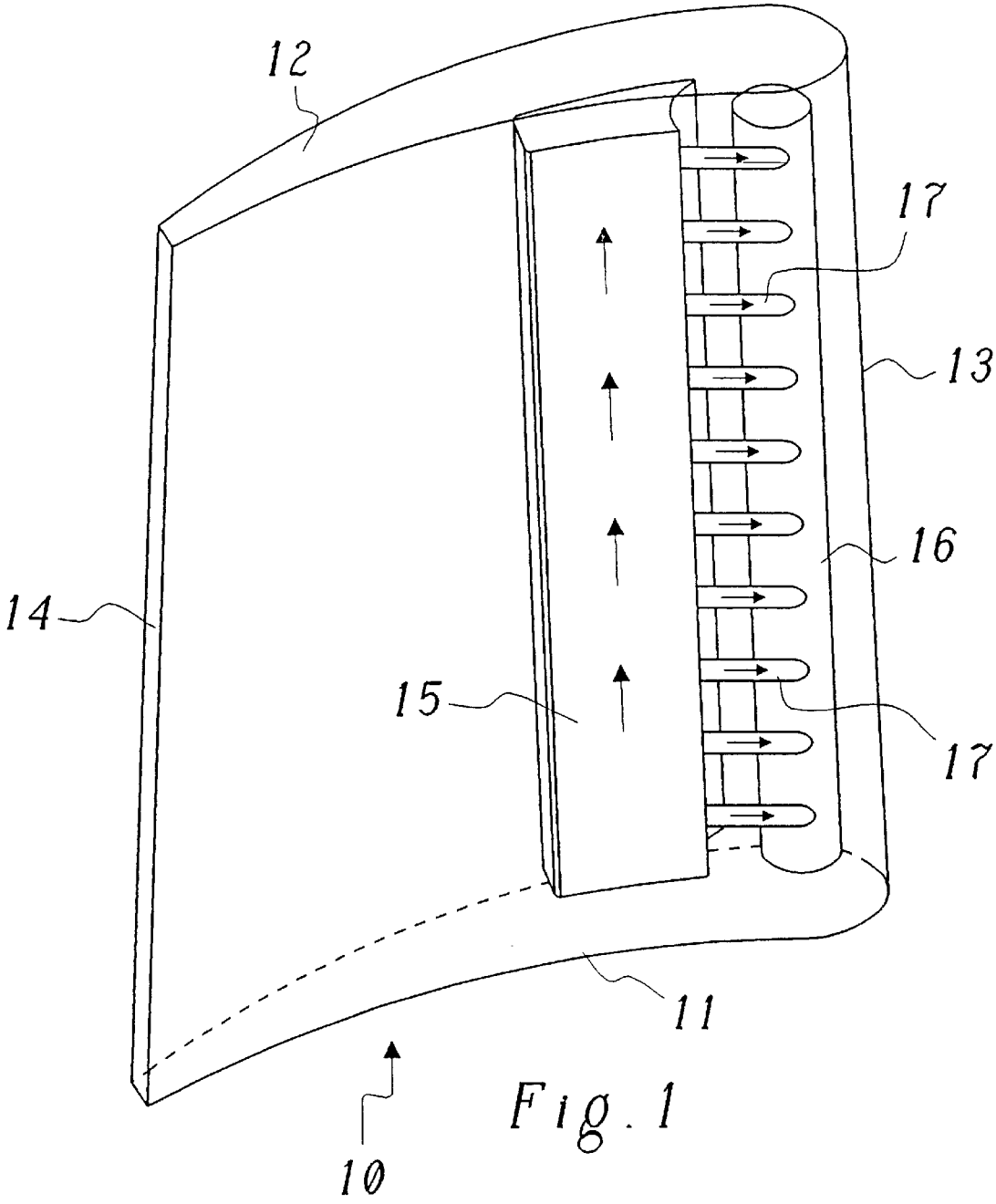
FIG. 1 shows a perspective side view of a turbine blade having internal cooling of the leading edge with a whirl or cyclone of cooling air generated in a cooling passageway.
Figure 3:
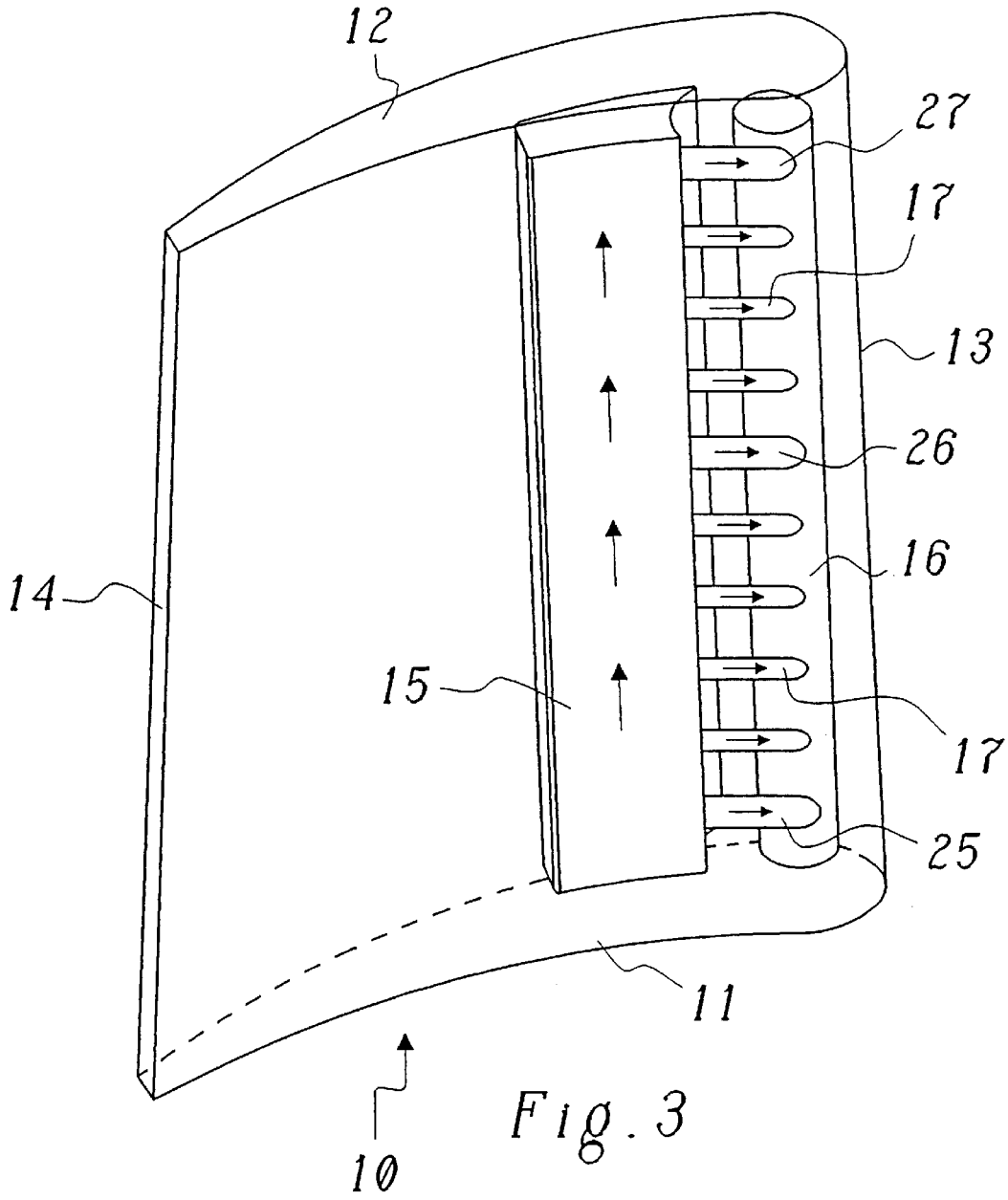

FIG. 3 shows, as an exemplary embodiment of an internally cooled gas turbine component according to the invention, a turbine blade 10' having features that improve the production rate. Components of the turbine blade 10' are marked with the same reference numbers as corresponding components for turbine blade 10 in FIG. 1. The coolant channel 15 and cooling passageway 16 of turbine blade 10' are connected with each other through a row of feeding holes 17, 25, 26 and 27. The majority of the feeding holes, i.e., the feeding holes 17, fulfill the criteria for generating a cyclone of cooling medium within the cooling passageway. These feeding holes each have a hole diameter that is smaller than half of the hydraulic diameter of the cooling passageway 16. Only a few selected feeding holes, i.e., the feeding holes 25, 26, and 27 in FIG. 3, have a hole diameter that is greater than half of the hydraulic diameter of the cooling passageway 16. These selected feeding holes 25, 26 and 27 allow for the production rate to be clearly increased during the manufacturing of the blades, as shall be explained below.

Figure 2:
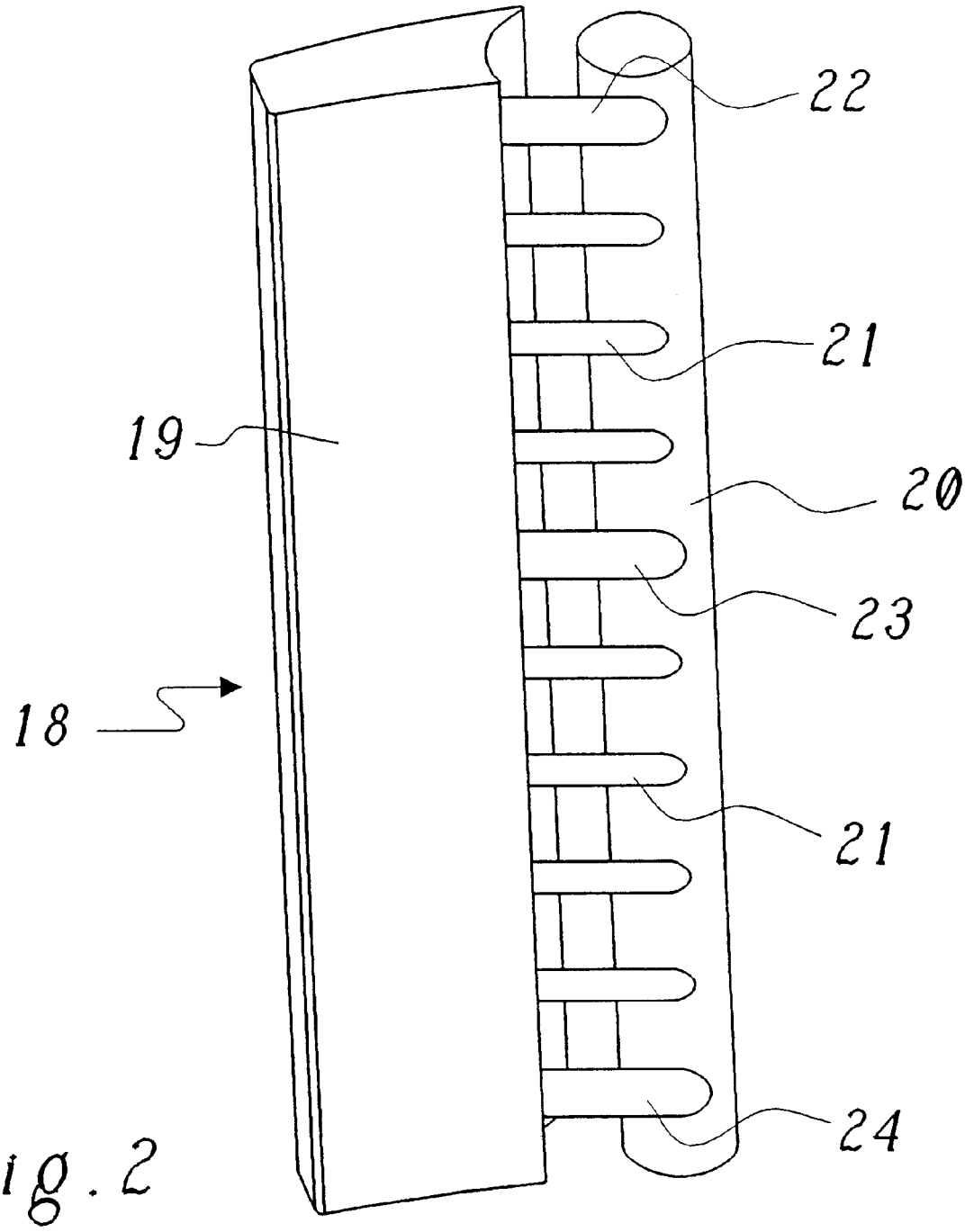
FIG. 2 shows a perspective side view of a reinforced casting core for manufacturing a turbine blade according to a preferred exemplary embodiment of the invention; and, FIG. 3 shows a perspective side view of a turbine blade according to an embodiment of the invention as manufactured with the casting core of FIG. 2.

In order to produce the turbine blade 10' by using a metal casting process, a casting core 18 of the type shown in FIG. 2 is required. The casting core 18 comprises a first channel part 19 required for forming the coolant channel 15 and a second channel part 20 that forms the cooling passageway 16. Both channel parts 19 and 20 are connected with each other by a row of spaced connecting members 21, 22, 23 and 24, all of which have a round cross-section. Most of the connecting members, i.e., the smaller diameter connecting members 21, are used to form the feeding holes that fulfill the above-described criteria for generating a cyclone of cooling medium. Only a few selected connecting members, i.e., connecting members 22, 23, and 24, are constructed with larger diameters, and in this way reinforce the connection between the core parts 19 and 20 and therefore the mechanical rigidity of the casting core 18 overall.

If the cooling passageway 16, or respectively the second channel part 20, is not very long, it would be sufficient to construct the two outer connecting members 22 and 24 as selected connecting members with an expanded cross-section. This enables the cooling air whirl or cyclone to form practically unhindered over the entire length of the cooling passageway 16. For longer cooling passageways 16, or respectively channel parts 20, it may be preferable and advantageous to provide additional individual selected connecting members 26 in the middle portion of the cooling passageway in order to make the casting core 18 more rigid there.

The diameters of the selected feeding holes 25, 26 and 27 or, respectively, the selected connecting members 22, 23 and 24, are in any case chosen to be greater than half of the hydraulic diameter of the cooling passageway 16. The actual size of the diameter will depend on the geometry of the casting core and the casting behavior and must be determined on an individual basis.

What is claimed is:

1. A cooled component for gas turbines, comprising:

an interior cooling passageway defined within said cooled component, said cooling passageway having a round cross-section;

a row of feeding holes for coolant, arranged relative to each other in the direction of the longitudinal axis of the cooling passageway, said feeding holes originating from a common coolant channel and ending at a tangent to said cooling passageway; and the majority of said feeding holes each having a hole diameter that is smaller than half of the hydraulic diameter of the cooling passageway, and selected feeding holes having a hole diameter that is greater than half of the hydraulic diameter of the cooling passageway.

2. The cooled component according to claim 1, wherein the selected feeding holes each are provided at end portions of the cooling passageway.

3. The cooled component according to claim 2, wherein the last feeding hole at one end of the cooling passageway and the first feeding hole at the opposite end of the cooling passageway are used as the selected feeding holes.

4. The cooled component according to claim 2, wherein at least one additional selected feeding hole is provided in the middle portion of the cooling passageway.

5. A casting core for manufacturing a component as claimed in claim 1, wherein said casting core comprises:

a first channel portion for forming the coolant channel and a second channel portion for forming the cooling passageway;

a plurality of connecting members that extend between the two channel portions and function to form the feeding holes, the majority of the connecting members each having an outer diameter that is smaller than half of the hydraulic diameter of the cooling passageway, and selected connecting members each having an outer diameter that is greater than half of the hydraulic diameter of the cooling passageway.

6. The casting core according to claim 5, wherein the selected connecting members each are provided at respective end portions of the second channel portion.

7. The casting core according to claim 6, wherein the first connecting member at a first end of the cooling passageway and/or the last connecting member at the opposite end of the cooling passageway are used as selected connecting members.

8. The casting core according to claim 6, wherein at least one additional selected connecting member is provided in the middle portion of the second channel portion.

9. A method for producing a component as claimed in claim 1, wherein a metal casting process is performed using a casting core according to claim 5.

* * * * *